US005967118A

United States Patent [19]

Hsu et al.

[11] Patent Number: 5,967,118

[45] Date of Patent: Oct. 19, 1999

[54] METHOD AND SYSTEM FOR ABSOLUTE ZERO THROTTLE PLATE POSITION ERROR CORRECTION

[75] Inventors: Chao Sen Hsu, Ypsilanti; Paul Michael Suzio, Livonia, both of Mich.

[73] Assignee: Ford Motor Company, Dearborn, Mich.

[21] Appl. No.: 09/005,891

[22] Filed: Jan. 12, 1998

[51] Int. Cl.[6] ..... F02D 11/10

[52] U.S. Cl. ..... 123/399

[58] Field of Search ..... 123/399, 395, 123/396, 397, 398

[56] References Cited

U.S. PATENT DOCUMENTS 5,003,948 4/1991 Churchill et al. .
5,016,588 5/1991 Pagdin et al. .
5,033,431 7/1991 Poirier et al. .
5,062,404 11/1991 Scotson et al. .
5,311,849 5/1994 Lambert et al. .
5,435,192 7/1995 Eagan et al. .
5,727,523 3/1998 Suzuki et al. ..... 123/399
5,735,244 4/1998 Machida et al. ..... 123/399

*Primary Examiner*—Erick R. Solis
*Attorney, Agent, or Firm*—Donald A. Wilkinson; Roger L. May

[57] ABSTRACT

A method and system for initial and ongoing calibration of the absolute zero throttle plate reference position used in an electronic throttle control system. The method compensates for shifts in the absolute zero throttle plate reference position that occur as a result of aging, wear, and thermal expansion/contraction by monitoring the torque output from a position controller when the throttle is commanded to be at the zero position, and correcting absolute zero position information until the torque required to maintain the absolute zero position is within a window extending between zero and that torque required to overcome a spring pre-load.

8 Claims, 2 Drawing Sheets

METHOD AND SYSTEM FOR ABSOLUTE ZERO THROTTLE PLATE POSITION ERROR CORRECTION

TECHNICAL FIELD

This invention relates generally to electronic throttle control systems and, more particularly, to a method and system for compensating for changes in the calibrated absolute zero position of the throttle plate.

BACKGROUND OF THE INVENTION

Electronic throttle control (ETC) systems position the throttle plate in response to a throttle plate position command from the engine control unit (ECU). One such system is disclosed in U.S. patent application Ser. No. 554,178 entitled "Method and System for Engine Throttle Control" filed Nov. 6, 1995, assigned to the assignee of the present invention, and incorporated herein by reference. All ECU plate position commands are referenced to the position at which the plate is closed in the throttle bore. In this position the throttle plate sector gear impinges upon a throttle return control screw (TRCS). The TRCS serves as an adjustment at the factory to set the plate closed position. TRCS is therefore the absolute zero throttle plate reference position for all ECU plate position commands. In order to accurately position the plate, the ETC control system must then reference all of its actions to the TRCS.

The ETC uses an electric motor to position the plate. The motor is physically connected to the plate shaft via a single stage spur gear train, consisting of a pinion gear which is ground into the end of the motor shaft and a mating sector gear which is attached to the plate shaft. Due to the limitations of mass production machinery, the gear train always has a certain amount of backlash, or "lost motion" from the input (pinion gear) to the output (sector gear). Backlash is the amount of pinion gear angular displacement required to move a pinion gear tooth from a position just engaging the sector gear tooth in the plate closing direction, to a position just engaging the adjacent sector gear tooth in the plate opening direction.

To accurately position the plate, the control system must have accurate information on the position of the motor shaft and the plate. Plate position can either be directly measured via a sensor located at the plate shaft, or inferred via a sensor located on the motor shaft. It is generally more economical to use a motor shaft position sensor to measure both motor and plate position. Accurate measurement of plate location by the motor shaft position sensor then depends on a known relationship between motor shaft rotation and plate rotation. Using a priori knowledge of the transfer function of an ideal (zero backlash) gear train, the ETC control system can infer plate position from the measured motor shaft position.

To establish the initial positional relationship (also known as absolute zero throttle plate reference position calibration) between the motor shaft angle and the plate angle, the plate must be moved to a known location such as TRCS, and the motor shaft position sensor interrogated. This value of position is then assigned as the absolute zero throttle plate reference position for the ETC control system. However, backlash produces a region of uncertainty between the actual plate location (at TRCS) and the inferred plate location from the motor shaft position sensor. This region of uncertainty corresponds exactly to the width of the backlash region, measured in degrees of motor shaft angular position.

In order to remove this uncertainty, the motor shaft pinion tooth should be engaged in the throttle opening direction, with the sector gear, when the absolute zero throttle plate reference position calibration measurement is performed. One method of achieving this objective puts the ETC in an open-loop mode, i.e., ignores the throttle position command and the throttle position. Instead, the ETC commands an amount of torque equals to ½ of the torque pre-load value for a short period of time in order to move the motor shaft in the opening direction but not the throttle plate. After the system settles down at the end of the period, it is assume that the motor shaft's pinion gear is in direct contact with the sector gear on the throttle shaft in the opening direction. The ETC stores this position (absolute zero throttle plate reference position) in memory and uses it for actual throttle position computation. The major disadvantage of this method is that it can only be executed when the engine is not running. Therefore, it is not practical for normal operation, but used only in the ETC assembly plant. Subsequent to assembly, shifts in the absolute zero throttle plate reference position occur as a result of aging, wear, and thermal expansion/contraction causing erroneous computation of actual throttle plate position.

SUMMARY OF THE INVENTION

In view of the position shift problem, a more accurate, consistent, and robust method of providing absolute zero throttle plate position information to the sensor is desirable. In accordance with the present invention a method and system is provided for initial (at the factory) and ongoing (in-service normal vehicle operation) calibration of the absolute zero throttle plate reference position. The method is more accurate, repeatable, and robust than the previously employed open loop method. It compensates for shifts in the absolute zero throttle plate reference position that occur as a result of aging, wear, and thermal expansion/contraction.

In accordance with the present invention a method of dynamically identifying the present absolute zero position of the throttle plate is proposed that uses the relationship between the load torque, as reflected to the motor shaft, and the motor shaft angular position, to infer the present absolute zero position. The torque load requirement increases with larger throttle plate position with a sizable offset near the zero position due to the spring pre-load. The amount of torque required to keep the throttle plate at zero position is defined by a window extending between zero and that torque required to overcome the spring pre-load. The method of the present invention monitors the torque output from the controller when the throttle is commanded to be at the zero position, and dynamically modifies or updates the absolute zero position information until the torque required to maintain the absolute zero position is within the aforementioned window.

BRIEF DESCRIPTION OF THE DRAWINGS

A more complete understanding of the present invention may be had from the following detailed description which should be read in conjunction with the following drawings in which.

DETAILED DESCRIPTION OF THE PREFERRED EMBODIMENT

Figure 1:
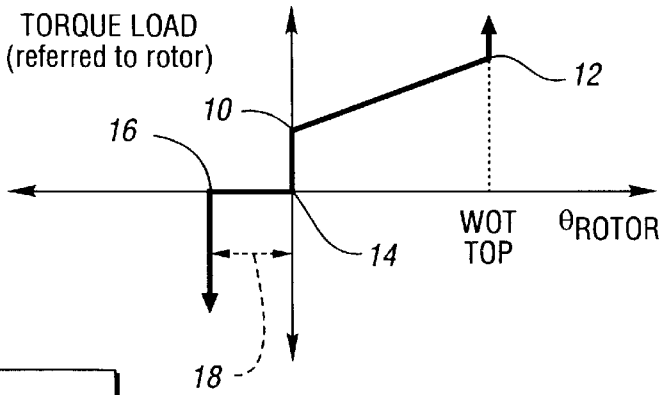
FIG. 1 is a torque load profile of the throttle plate.

Referring now to the drawings and initially to FIG. 1, the torque load profile of the throttle plate shows a torque pre-load at 10, which is the amount of torque required to overcome the mass of the throttle plate, friction etc. This is the minimal amount of torque needed to start moving the throttle plate. As indicated there is a significant difference between the amount of torque required at the zero position 12, and say 1 degree of motor rotor rotation. After the pre-load is overcome the required torque per degree of motor rotor rotation is substantially linear until the wide open throttle (WOT) stop is encountered at 14. When moving from a positive angular position to the absolute zero position 12, the throttle return spring drives the throttle plate into the throttle return control screw (TRCS) position 16. The width of the backlash is indicated at 18. At the TRCS position 16, the motor attempts to drive the throttle sector gear into the stop with the same essentially infinite torque load (referred to the motor rotor) encountered at the WOT stop. With the ETC system operating as a closed loop position servomechanism, the following characteristics are observable by the ETC control system, via the motor shaft position sensor and the output torque command of the position controller. When the motor shaft position is between the upper and lower backlash limits, the motor control system output required to move the motor shaft is very low (small torque per unit of shaft displacement). In this region the motor pinion tooth is disengaged from the throttle plate sector gear teeth. When the motor shaft moves toward the lower backlash limit, and the motor pinion tooth has just engaged the sector gear tooth, any further motion in this direction requires a large negative increase in torque for a very small negative increase in motor shaft position. When the motor shaft moves toward the upper backlash limit, and the motor pinion tooth has just engaged the sector gear tooth, any further motion in this direction requires a large positive increase in torque for a very small positive increase in motor shaft position (and throttle plate position). This condition continues until the motor produces sufficient torque to overcome the resistance of the throttle return (closing) spring (i.e., torque pre-load). Positive motion is understood to be that which results in the throttle plate rotating in the opening direction.

Figure 2:
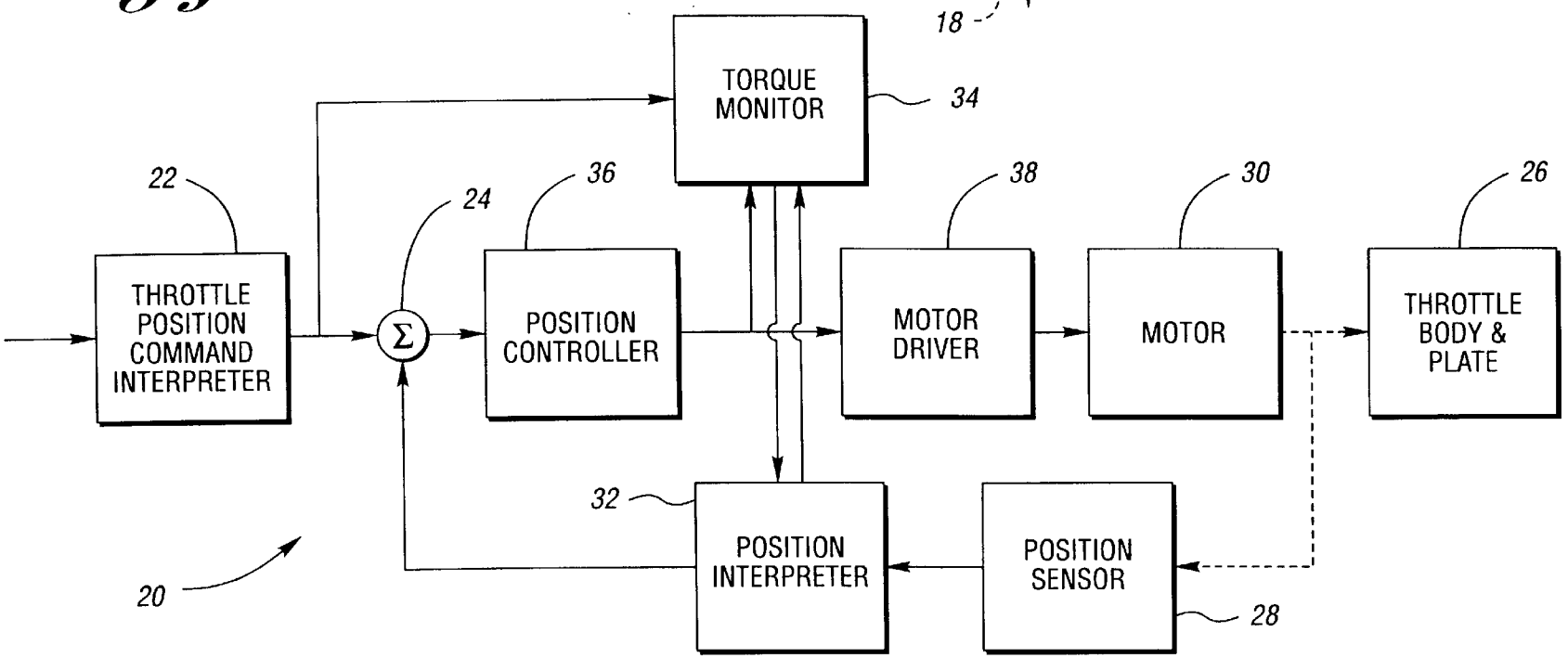
FIG. 2 is functional block diagram of the invention.

Referring now to FIG. 2, the throttle plate position control system of the present invention is generally designated 20. The system 20 includes a throttle command interpreter 22 responsive to a throttle position command input. The throttle command input may, for example, be provided by a powertrain control module or other controller (not shown) responsive to the position of the accelerator pedal or may be incorporated in the throttle position control system. The interpreter 22 provides a desired throttle position command to a summer or error detector 24 that provides an output equal to the difference between the commanded position and the actual position of a spring biased throttle plate 26. The actual position of the throttle plate 26 is detected by a position sensor 28 that is mechanically coupled to the shaft of a motor 30. The motor 30 positions the throttle plate 26 through a gear train (not shown). It will be understood that instead of a gear train other devices for coupling the prime mover (motor) and load (plate), with or without a mechanical advantage, where the coupling has a backlash (or lost motion) characteristic could be employed. A position interpreter 32 is responsive to the position output of the sensor 28 and to an absolute zero position input from a torque monitor 34 to provide the actual throttle position input to the summer 24. The position interpreter 32 converts the signal from position sensor into a digital value, retrieves the present value of absolute zero throttle plate reference position from memory or directly from the torque monitor block 34 and determines actual throttle position equal to the sensor position value minus the absolute zero throttle plate reference position. The throttle position error output of the summer 24 is input to a throttle position controller 36 providing proportional, integral, and derivative control in order to minimize any difference between commanded and actual throttle plate position. The output of the controller 36 is input to a motor driver block 38 that responds by supplying the proper motor current to the motor 30.

The torque monitor 34, uses the torque signal provided by the controller 36 and the torque discontinuity at TRCS as the reference point for the throttle plate's zero position. The interpreter 32 provides a status signal to the monitor 34 when the throttle plate is in a steady state condition. If the steady state condition exists and the throttle plate command from the command interpreter 22 is zero, the block 34 detects the torque magnitude needed to maintain stable throttle plate position. If the required steady-state torque is larger than a predetermined torque pre-load or is a negative value, the monitor 34 adjusts the previously determined zero position until the torque output is between zero and the torque pre-load value. This updated zero position is then supplied to the position interpreter 32.

Figure 3:
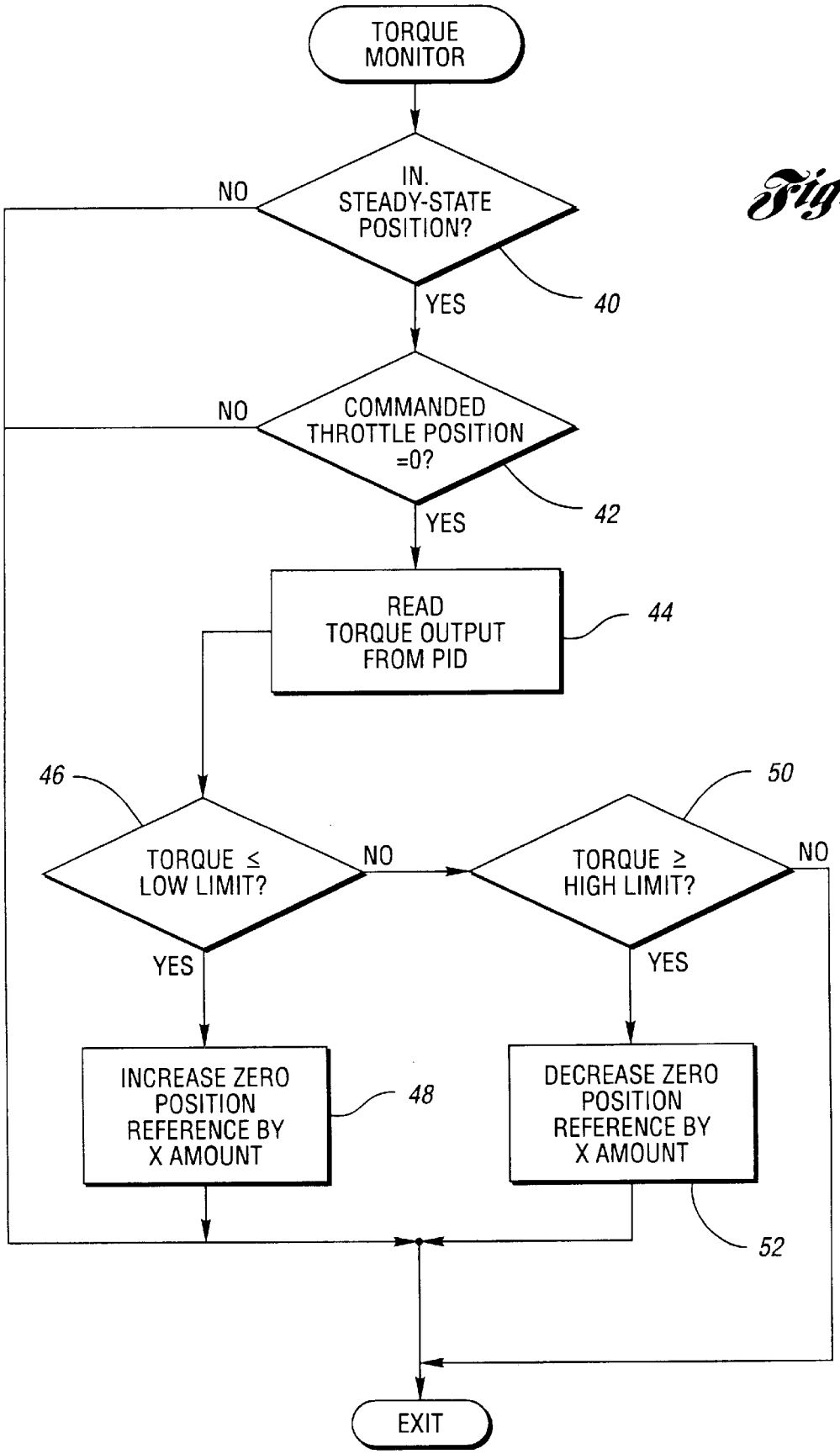
FIG. 3 is a flowchart depicting the method of the present invention.

A flowchart of the method of determining absolute zero throttle plate position is shown in FIG. 3. This routine is executed periodically, for example, every 5 milliseconds. If the throttle position output is in a steady state condition, i.e., essentially constant for a predetermined time interval, as determined in decision block 40, then the commanded throttle position is checked at block 42 to determine whether the zero position is commanded. The absolute zero position is updated only during a steady state response to a zero position command. If so, the torque output is read at block 44. If the steady state torque is less than or equal to a predetermined lower limit value as determined at block 46, then the zero position reference is increased by a predetermined amount at block 48. Otherwise, the steady state torque is checked at block 50 to determined if the torque is equal to or greater than an predetermined upper limit value. If so, the zero position reference is decreased by a predetermined amount at block 52. Thus, the effect is to maintain the zero position reference torque within a window defined by the predetermined upper and lower limits. The predetermined upper and lower limits are torque values between the value corresponding to a pre-load torque value and zero respectively.

While the best mode for carrying out the present invention has been described in detail, those familiar with the art to which this invention relates will recognize various alternative designs and embodiments for practicing the invention as defined by the following claims.

What is claimed is:

1. In an electronic throttle control system including a controller for determining the load torque required to maintain a commanded throttle plate position based on the error between the commanded throttle plate position and an actual throttle plate position, said actual throttle plate position being supplied to said controller by a position sensor, a method of dynamically compensating for changes in absolute zero throttle plate position comprising a sequence of the steps of:

monitoring said load torque to detect the steady state load torque required to maintain a zero throttle plate commanded position; and modifying the actual throttle plate position supplied to said controller if the magnitude of the steady state load torque is above or below predetermined upper or lower torque values respectively.

2. The method defined in claim 1 wherein the actual throttle plate position is comprised of sensed throttle plate position and a zero throttle plate position, and said modifying step comprises a step of:

adding a zero throttle position correction value to said zero throttle plate position if said load torque is less than said predetermined lower limit.

3. The method defined in claim 2 wherein said modifying step comprises a step of:

subtracting a zero throttle position correction value from said zero throttle plate position if said torque is greater than said predetermined upper limit.

4. The method defined in claim 3 wherein said monitoring step comprises the steps of:

detecting a zero position command to said system; and detecting a stable load torque for a predetermine interval of time to determine said steady state torque.

5. In an electronic throttle control system including a controller for determining the load torque required to maintain a commanded throttle plate position based on the error between the commanded throttle plate position and an actual throttle plate position, said actual throttle plate position being supplied to said controller by a position sensor and including a sensed throttle plate position modified by the absolute zero throttle plate position, the improvement comprising a torque monitor for dynamically compensating for changes in absolute zero throttle plate position, said monitor responsive to said load torque and to said commanded throttle plate position to adjust the zero throttle plate position to maintain the steady state load torque within predetermined upper or lower torque values when zero throttle plate position is commanded.

6. The system defined in claim 5 wherein a correction is added to said zero position if said load torque is less than said predetermined lower limit.

7. The system defined in claim 6 wherein a correction is subtracted from said zero position if said load torque is greater than said predetermined upper limit.

8. The system defined in claim 7 wherein said monitor responds to a zero position command supplied to said system and a steady state throttle plate position.

* * * * *

UNITED STATES PATENT AND TRADEMARK OFFICE

CERTIFICATE OF CORRECTION

PATENT NO : 5,967,118

DATED : October 19, 1999

INVENTOR(S) : Chao Sen Hsu et al

It is certified that error appears in the above-identified patent and that said Letters Patent is hereby corrected as shown below:

In Figure 1, numeral "12" should be --14--; "14" should be --12--; and "WOT TOP" should be --WOT STOP--.

Signed and Sealed this

Eighth Day of August, 2000

*Attest:*

*Attesting Officer*

Q. TODD DICKINSON

*Director of Patents and Trademarks*